United States Patent [19]

Nilsson et al.

[11] Patent Number: 4,605,073

[45] Date of Patent: Aug. 12, 1986

[54] DEVICE IN NEEDLE HAMMERS

[76] Inventors: Göran A. Nilsson, Box 61, Sandarne, Sweden, S-820 22; Kjell E. E. Edström, Åsbäcksgatan 43, Söderhamn, Sweden, S-826 00; Henry W. Wiklund, Bäckvägen 1, Arbrå, Sweden, S-820 10

[21] Appl. No.: 624,928

[22] Filed: Jun. 27, 1984

[30] Foreign Application Priority Data

Jul. 1, 1983 [SE] Sweden ..... 8303760

[51] Int. Cl.[4] ..... B21C 43/00

[52] U.S. Cl. ..... 173/51; 173/53; 173/119; 29/81 D; 279/102

[58] Field of Search ..... 173/53, 101–103, 173/118–120, 139, 50, 51, 92; 92/85 B; 72/399, 453; 279/102, 19; 144/115; 30/164.6, 169; 29/81 D, 81 G, 81 R, 81 L; 227/149, 30

[56] References Cited

U.S. PATENT DOCUMENTS

| | | | |
|---|---|---|---|
| 2,426,200 | 8/1947 | Green | 279/102 |
| 2,624,102 | 1/1953 | Green | 279/1 Q |
| 2,672,677 | 3/1954 | Von Arx | 29/81 D |
| 2,779,085 | 1/1957 | Schoengarth | 29/81 D |
| 2,789,653 | 4/1957 | Fannen | 279/1 Q |
| 3,023,485 | 3/1962 | Barthod | 29/81 D |
| 3,399,441 | 9/1968 | Imamura | 29/81 G |
| 3,680,643 | 8/1972 | Cameron et al. | 173/133 |
| 4,158,522 | 6/1979 | Wirfelt | 279/1 Q |
| 4,239,143 | 12/1980 | Johnson | 227/149 |
| 4,343,368 | 8/1982 | Fadeev et al. | 173/139 |

*Primary Examiner*—Donald R. Schran
*Assistant Examiner*—James L. Wolfe
*Attorney, Agent, or Firm*—Eric Y. Munson

[57] ABSTRACT

A device in pressure medium operated needle hammers, the needles (24) being arranged in a reciprocatingly movable working member (3) by at least one flexible holder member (31, 39) and, by a friction grip of the holder member being caused to follow the movements of the working member, but being permitted an axial play within predetermined limits through overcoming the frictional resistance. In addition, the rear portions of the needles can be arranged in a sealed chamber (34) filled with a hydraulic medium (35).

4 Claims, 3 Drawing Figures

DEVICE IN NEEDLE HAMMERS

Figure 1:
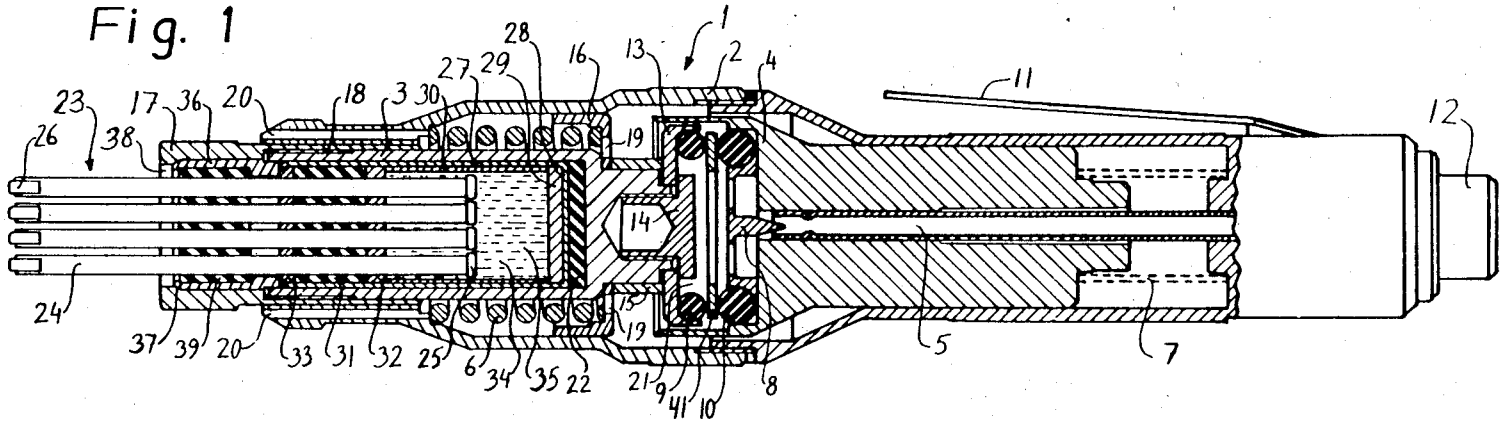

The present invention relates to a device in so-called needle hammers or needle scalers driven by means of a pressure fluid. In needle hammers of the known type, the needles are usually arranged in a holder in which, independently of each other, they are axially movable a limited distance in order to permit adjustment in relation to unevennesses of a workpiece surface and/or an oblique angle of approach to this surface. The working effect is obtained by means of a reciprocating member arranged behind the needle assembly, which member during its forward movement strikes against the heads of the needles. During each stroke, the needle or needles taking up the rearmost position will, via their heads, receive the impact energy delivered, or the main part thereof, while those needles which take up a more forward position will not at all, or only with reduced power, be hit by the impact member.

This known principle entails a number of disadvantages:

1. For each work cycle, the working effect of the different needles of the needle assembly varies so considerably that all the needles cannot be regarded as doing any useful work.

2. Due to the uneven distribution of the impact force, individual needles can be subjected to overloads causing durability problems.

3. The operation of the impact member produces a recoil effect, as well as shock waves which via the housing of the tool are transmitted to the hands of the operator and which, after extended use of the tool, may cause occupational injuries, such as so-called white fingers.

4. The sound level during the operation of the tool is high, partly due to the shock pulses generated when the impact member strikes against the heads of the needles, and partly due to the fact that the needles are usually guided with a relatively large play which permits them to swing in their lateral direction and clatter against each other and their retaining member or members.

According to the present invention, a device is suggested by means of which the forces transmitted to the needle assembly of the tool are more evenly distributed to the individual needles, whereby the strains on these are reduced and whereby a larger simultaneous amount of work is performed per work cycle, since driving power is delivered to each needle. Further, the characteristics of the device make it suitable for obtaining, at the same time, an efficient damping of recoil and percussion forces and rattle-free guiding of the needles. These objects have been attained with the device in accordance with the invention chiefly by arranging the needles in a reciprocating working member fitted with at least one holder member made of an elastic material and clasping each needle by means of a friction fit, and by the needles being arranged to follow the reciprocating movements of the working member but having the possibility of individual axial displacement through overcoming the friction resistance of the holder member. In addition, the rear portions of the needles can be arranged to penetrate into a cavity in the working member which is sealed in all directions; that cavity volume which is not occupied by the rear portions of the needles being filled up by a medium serving as a hydraulic fluid acting on the rear ends of the needles to absorb and distribute the axial forces acting on the needles.

Figure 2:
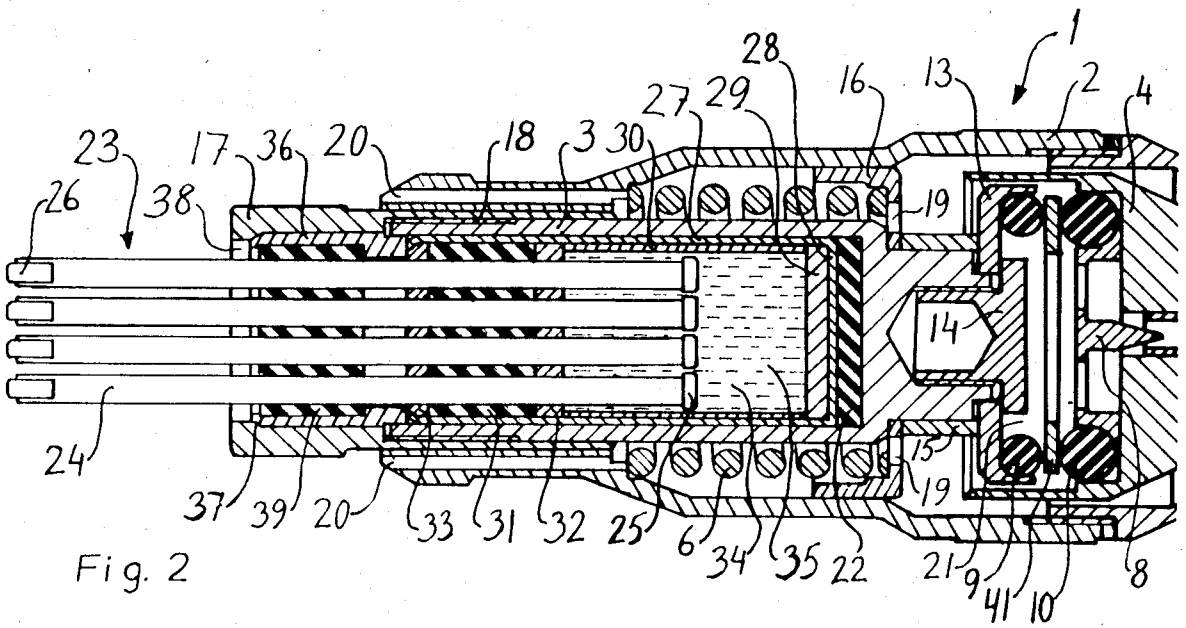
Figure 3:
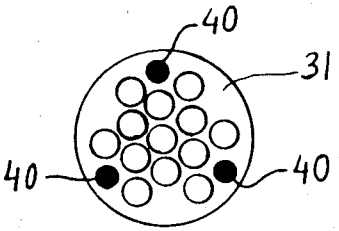

The device in accordance with the invention will be described in closer detail in the following, with reference to the attached drawings, of which FIG. 1 shows a sectional side view of a needle hammer fitted with a device in accordance with the invention, FIG. 2 shows, on a larger scale, a sectional side view of the front section of the same needle hammer, and FIG. 3 shows an end view of some details of the device.

In the drawings, the numeral 1 denotes the needle hammer in general, and 2 its outer shell or housing. A reciprocating working member 3 is balanced, in order to obtain recoilless operation, by a reaction member 4 which describes opposite movements. The two members are affected, on the one hand, by a pressure medium which is admitted through a conduit 5 to a working chamber 21 formed between the members, said medium striving to separate the members and, on the other hand, by springs 6, 7 which, when the chamber is opened during the separating movement, return the members in a direction towards each other. Therefore, the members will perform a rapid series of reciprocating movements, as long as the supply of pressure medium continues. In the working chamber, a feed valve 8 can be provided, which during the movements of the reaction member 4 alternatively blocks and uncovers the outlet opening of the conduit 5 for pressure medium. Elastic seals 9, 10 serve as sealing means for the working chamber and can consist of O-rings. As a contact member between these a washer 41 is provided.

The principle for the drive mechanism with the elastic seal rings 9, 10 is described in closer detail in the Swedish Pat. No. 7509370-1 corresponding to U.S. Pat. No. 4,088,062, the balancing device with the reaction member 4 in the Swedish Pat. No. 7603252-3 corresponding to U.S. Pat. No. 4,117,764, and the feed valve 8 in the Swedish patent application No. 8204044-5 (no corresponding U.S. application).

The numeral 11 denotes a control lever for opening and closing the supply conduit 5 for pressure medium by means of a valve device not shown, and 12 is a connection nipple for connection of the tool to a source of pressure medium.

The working member 3, and the parts related to same, are best shown from FIG. 2. The rear end of the working member is fitted with a drive plate 13 retained by means of a screw 14 which clamps the drive plate against one end of a spacer sleeve 15. Between the opposite end of the spacer sleeve and a shoulder of the working member 3 a flanged ring 16 is clamped which serves as a slide bearing for the working member in the housing 2. At its front end, the working member 3 is guided radially by means of the nut 17, which is threaded on the working member by means of a thread 18 and is slidingly journalled in the front section of the housing 2. In the bearing ring 16 and the front section of the housing, holes 19, 20 are provided for evacuating the pressure medium which is discharged radially from the working chamber 21 past the seals 9, 10 when the chamber opens during the separating movement of the working member 3 and the reaction member 4.

The working member 3 is shaped as a cylinder open at one end. Against its bottom or end wall, a buffer plate 22 of elastic material such as a polyurethane plastic of a relatively hard quality is supported. In the hollow working member 3, a needle assembly 23 is arranged. The assembly comprises a number of needles 24 having heads 25 at their rear ends and short tungsten carbide pins 26 brazed in holes in the front ends of the needles. Further, the needle assembly includes a sleeve 27 with an end wall 28, a metal washer 29 supported against said wall, a spacer tube 30, a washer 31 of elastic material, such as a polyurethane plastic, and, on opposite sides of this washer, guide washers 32, 33 of a harder material, such as metal or a hard plastic. The washers 31–33 are provided with holes through which the needles 24 can be passed. The washer 32, the spacer tube 30 and the washer 29 define a chamber 34, part of which is occupied by the rear portions of the needles 24. The remaining chamber volume can be filled with a medium 35 which serves as a hydraulic medium. The needle assembly 23 can be made to keep together as a self-contained unit by joining the washer 33 and the end portion of the sleeve 27 together, e.g. by squeezing together said end portion around a narrowing end portion of the washer. In this form of one single unit, the needle assembly 24–35 can be inserted into and pulled out of the working member 3.

The needle assembly 23 is secured in the working member 3 by means of a sleeve 36, the inner end of which penetrates a short distance into the working member 3 and exerts pressure on the washer 33. The sleeve 36 is surrounded by the nut 17 which has a tapering internal end portion 37 against which a correspondingly tapered portion of the sleeve is supported. The clamping pressure of the sleeve against the washer 33 is obtained by tightening of the nut 17. To obtain locking of the nut, to prevent its unwinding from the working member 3 when the needle hammer is operated, the sleeve 36 and the working member 3 should be non-rotatably connected to each other, and the nut locked by friction against the tapered end of the sleeve. The non-rotatable connection can be obtained by means of a nib or the like extending radially from the sleeve 36 and connecting with a slt or groove in the end portion of the working member 3. A reliable friction locking between the sleeve and the nut is obtained by means of a suitable choice of the shape of their tapered contact faces against one another, if necessary improved by slotting the end of the sleeve, so that it is compressed under resistance from a springing action, when the tapered surfaces are pressed against each other. To prevent the working member 3 and the sleeve 36 from co-rotating when the nut 17 is turned, a claw spanner or similar can be used, the protruding claws of which are inserted into slots at the outer end of the sleeve 36 through an opening 38 of the nut.

In the sleeve 36 is fitted a guide washer 39 provided with holes for the needles 24 and suitably made of an elastic material similarly to the washer 31. The guide washer 39 is retained in the sleeve 36 in a suitable way, for example by having been forced past a constricted portion of the sleeve.

In the embodyment illustrated, the sleeve 31 serves to seal the chamber 34 completely against leakage of hydraulic medium 35. Therefore, the washer should be pre-tensioned with the necessary amount of force by means of compression between the washers 32, 33, which is done in connection with the washer's being forced into the sleeve 27 and joined to same, so that the complete needle assembly forms a joined-together and closed unit. In addition, the nut 17 will, when tigtened, exert pressure on the washer 33 via the sleeve 36 on which the nut acts, which will further secure the joint. Due to its axial compression, the washer strives to expand radially, whereby it will press against the needles 24 as well as the surrounding wall of the sleeve 27 and seal efficiently against these.

To avoid variations in the pre-tension of the elastic washer 31, it is suitable to provide the washer with a number of spacer pins 40 (FIG. 3), which are inserted into the washer outside the periphery of the series of holes for the needles 24 and which are a little shorter than the axial dimension of the washer 31, so that the washer is given the right amount of pre-tensioning when compressed a distance equal to the difference in length between the washer and the pins. When this has been done, the ends of the pins 40 will support against the washers 32, 33, and prevent further compression. Hereby, an entirely rigid axial connection is obtained all the way from the nut 17 to the bottom of the sleeve 27, by means of the different washers and spacer elements.

In contrast to the elastic washer 31, the elastic guide washer 39 does not need to be pre-tensioned and provided with spacer pins 40, since it only serves to guide the needles 24 radially, and slightly resiliently. The needles are guided both by the washers 32, 33, to prevent radial forces on the needles from acting disadvantageously on the sealing function of the elastic washer 31, and by the guide washer 39. The elasticity of the guide washer prevents the forming of a sharply defined breaking point on the needles 24, when these are subjected to radial forces during the operation of the needle hammer, but the deflection of the needles will be along an arc having a long radius. Provided that a suitable steel quality is chosen for the needles, they can withstand the radial forces without buckling and permanent deformation. Thanks to the resilient guiding of the needles and their being deflected mainly inside or close to the washer 39, and to their being journalled along a long total distance in the different washers, there are no problems with misalignment of the needles causing a prying or scraping effect against the edges of the holes in the washers 32, 33.

The mode of functioning of the needle hammer in accordance with the embodiment illustrated is as follows: By operation of the control lever 11, the feeding of pressure medium to the working chamber 21 is started, whereby the working member 3 and the reaction member 4 are caused to reciprocate towards and away from one another. The total volume occupied by the rear ends of the needles 24 in the chamber 34 is kept substantially constant, since the hydraulic medium 35 resists to being compressed due to a rearward movement of all the needles of the needle assembly 23, and since a corresponding forward movement, too, is conuteracted by the creation of a vacuum in the chamber 34. In addition, the friction grip of the elastic washers 31 and 39 around the needles contribute to the retaining of these in their positions. Consequently, the needles 24 will follow the reciprocating movements of the working member 3. If, however, during its forward stroke, the needle assembly strikes against a work surface which is at an oblique angle to the direction of movement of the needles and/or presents elevations or cavities, so that all the portions of the work surface will not be simultaneously hit by all the needles, the needles which are the first to hit the work surface will be loaded and forced backwards in the chamber 34, the unloaded needles being forced in the forward direction a corresponding amount, partly due to the overpressure produced in the chamber 34 by the needles which are forced back, and acting on the rear ends of the unloaded needles, and partly due to the kinetic energy stored in the unloaded needles which makes them strive to continue their forward movement of their own accord. The needle assembly will hereby quickly adjust in the axial direction, so that the positions of the needles will correspond to the unevennesses of the work surface, or its inclination to the direction of stroke of the needle hammer, and all the needles will, mainly simultaneously, hit the work surface and absorb mainly the same amount of load, i.e. will mainly do the same amount of useful work.

This evening out of the loads is of great importance for the durability and life of the needles, and for the total amount of processing force which can be used. Further, a strongly contributing factor is the driving of the needles by means of a friction grip and a hydraulic medium, and not by means of metallic impacts against their heads. The needles' being elastically supported in the guide washer 39 is an additional important advantage, since no sharply defined point of buckling is created when the needles deflect as they are loaded during the processing of a work surface.

The amount of hydraulic medium 35 in the chamber 34 should be adjusted in such a way that the needles 24, when all of them are inserted the same distance into the chamber, have their rear ends in the middle of it. When the needles work in the way described above, certain needles will be pushed forward, and certain needles backward, from this mean position but, normally, not to such an extent that their heads contact the front or rear end wall of the chamber 34. This can occur only in case of considerably differing levels on a work surface. If, for example, the tool is operated close to the edge of a workpiece, with the majority of the needles engaging the workpiece, but one or two passing outside its edge and meeting no resistance, the result is that the loaded needles go backwards a short distance, while the added change of volume caused by these movements in the chamber 34 causes the smaller number of unloaded needles to be pushed forward a longer distance, until the undersides of their heads contact the washer 32. This only means a slightly increased pressure on the washer, which is already, on the surfaces of its end wall which surround the needles, subjected to the same pressure per unit of surface as that acting on the rear ends of the needles. The washer 32 is thus not subjected to any loads which are hard to handle. In case of such load conditions that certain needles are forced backwards all the way to the washer 29 at the rear end of the chamber 34, the impact load which is thereby absorbed by the washer 29 and the end wall 28 of the sleeve 27 is damped by the elastic buffer plate 22. Such load conditions will occur only if the tool is used in such a way that only an individual needle, or a few needles, engage a workpiece, the majority of the needles going clear of it. Such a method of working is, of course, unsuitable for extended use, since the few needles working have to carry the total load alone. In normal cases, this method of working should not be needed, either. For the processing of very narrow surfaces, a needle assembly with few needles should be chosen, in order for its diameter to correspond in a suitable way to the application.

The axial length of the chamber 34 should, of course, be chosen in order to provide sufficient room for the backward and forward movements of the needles from their mean position, for example 15–20 mm in either direction.

When the needles impact against a work surface, the driving method described results in force pulse characteristics which produce considerably less strain on the material in the form of compression waves and tensile waves travelling through the needles than would be the case if, in the conventional way, they were subjected to metallic impacts against their heads simultaneously with being engaged against a hard work surface. It is therefore possible to fit the impact ends of the needles with tungsten carbide tips, for example in the form of short pins 26 of a relatively tenacious tungsten carbide quality. This increases the efficiency of the needles considerably and provides for tips which stay sharp all the time. Conventional, hardened steel needles are relatively quickly deformed at their ends. The tungsten carbide tips and the advantageous arrangement and driving of the needles in the device in accordance with the invention result in a many times longer life of the needle assembly.

The chamber 34 which is filled with hydraulic medium must be sealed so completely at its forward end wall that the needle hammer can be used for a long time without loss of such an amount of hydraulic medium along the needles 24 or the side walls of the sleeve 27—past the elastic washer 31—that the mean penetration of the needles into the chamber 34 increases until they have to little play backwards. It has provided advantageous to use a medium which has less tendency towards seepage than ordinary hydraulic oil. In a prototype of a device in accordance with the invention, a silicone monomer having a high molecular weight and advantageous sealing properties was used with a good result. The medium used has a high viscosity and tenacity and keeps together internally but has a low tendency towards adhering to the needles and following these through the seals in the form of a thin film.

When the needle hammer is operating, the movements of the impact member 3 and the reaction member 4 balance one another, so that no recoil forces are produced. The percussion forces which, when the needles 24 work against a workpiece, are transmitted to the working member 3, are damped by the hydraulic medium 35 and are thereafter for the main part absorbed by the counterbalanced and cushioned drive system of which the working member is a part. During the separating movement of the working and reaction members, braking and reversing of the movement is accomplished against the springs 6, 7, while the return movement is damped by means of a combination of an air cushion effect—when the members approach one another and the pressure increases in the chamber formed between them—and a spring action of the elastic seals 9, 10. It should further be noted that the drive chamber 21 between the working member 3 and the reaction member 4 has no exactly defined axial position, but is formed where the members meet during their return movement depending on the load variations on the working member. Therefore, the drive system is, to a high degree, self-compensating for varying loads.

Trials have shown that it is also possible to use a needle hammer mainly in accordance with the embodiment shown in FIGS. 1–2, but with no hydraulic medium in the chamber 34. In this case, the needles 24 are made to follow the movements of the working member 3 only by means of a friction grip around them by an elastic washer 31, possibly supplemented by an elastic guide washer 39. The friction grip should be so adjusted that a certain amount of sliding of the needles axially in relation to the friction element occurs during the acceleration at the end positions of the strokes. Since the type of impact mechanism described operates in such a way that the working member 3 is accelerated faster at the beginning of a forward stroke than at the beginning of a return stroke, the needles will, when the tool is operated with the needles unloaded, work their way backwards to the rear end wall of the chamber 34. Needles impacting against a work surface are therefore supported by this wall. Needles which do not immediately hit the work surface, due to its being uneven or inclined, are thrown forwards on account of a sharp braking of the working member 3 and its elastic friction elements which hold the needles, caused by the contact between the rear ends of the needles hitting the work surface and the rear end wall of the chamber 34. Therefore, an axial adjustment of the needles with regard to an uneven or inclined work surface is obtained, so that all portions of the work surface are processed. However, the distribution of the loads and the working efficiency will not be as good as for the alternative described above, with a chamber 34 filled with a hydraulic medium. for light-duty applications, however, the design may be usable. The advantage is that the design is simpler and cheaper on a few points.

The invention is not limited to the embodyment illustrated and described, but may be varied within the scope of the following claims.

We claim:

1. A needle hammer device including a working member (3), at least one holder (31,39) formed from a flexible material and mounted to said working member, said holder defining a plurality of openings therein for receiving a neelde in each of said openings and retaining said needles in said openings by frictional engagement with said holder, one end of each of said needles extending from said holder in a forward direction, said working member being reciprocatingly movable together with said holder and said needles in the axial direction of said needles, said needles being retained in said holder to permit individual axial movement of each of said needles relative to said holder, within predetermined limits, by overcoming the resistance of the frictional engagement by said holder, the other end of each of said needles extending from said holder in a rearward direction, a sealed chamber for holding a fluid medium defined in said working member behind said holder such that said other ends of said needles extend into said chamber, wherein axial movement of any of said needles into said chamber causes fluid medium in said chamber to exert a force on said other ends of each of said needles.

2. A needle hammer device including a working member (3), at least one holder (31,39) formed from a flexible material and mounted to said working member, said holder eing designed to receive and retain a plurality of needles (24) extending from said holder, said working member being reciprocatingly movable together with said holder and said needles in axial directin of the needles, a sealed chamber for holding a hydraulic medium in said working chamber defined by a forward end wall (32), a rear end wall (29) and an annular wall (30), the rear end portion of each of said needles extending into said chamber, the forward end portion of each of said needles extending in a forward direction from said forward end wall (32) and each of said needles being frictionally supported in a plurality of bearing means in said forward end wall (32) permitting individual axial movement of each of said needles relative to said holder against the force exerted by the hydraulic fluid while maintaining said chamber sealed against escape of hydraulic fluid.

3. Device according to claim 2, characterized in that at least one holder member (31, 39) is arranged to be compressed between contacting members (27, 32, 33), one of which (32) can, at the same time, constitute the above-mentioned bearing means and forward end wall, respectively, in order to obtain clamping forces acting on the needles (24), and a frictional resistance determined by these forces, as well as a good sealing action against the needles and the contacting members (27, 32, 33).

4. Device according to claim 3, characterized in that a plurality of spacer members (40) are inserted in at least one holder member (31, 39), said pins acting, when the holder member is compressed between two contacting members (32, 22) which act against opposite sides of the holder member, as a stop for said contacting members and determining, thereby, the maximum amount of compression.

* * * * *